US009721716B1

(12) United States Patent
Folker

(10) Patent No.: US 9,721,716 B1
(45) Date of Patent: Aug. 1, 2017

(54) MAGNETIC COMPONENT HAVING A CORE STRUCTURE WITH CURVED OPENINGS

(75) Inventor: Donald Folker, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 566 days.

(21) Appl. No.: 13/036,303

(22) Filed: Feb. 28, 2011

Related U.S. Application Data

(60) Provisional application No. 61/308,322, filed on Feb. 26, 2010.

(51) Int. Cl.
*H01F 27/24* (2006.01)
*H01F 27/28* (2006.01)

(52) U.S. Cl.
CPC ..... *H01F 27/24* (2013.01); *H01F 27/28* (2013.01)

(58) Field of Classification Search
USPC ..... 336/233, 221, 214, 212, 198
See application file for complete search history.

(56) References Cited

U.S. PATENT DOCUMENTS 2,400,994 A * 5/1946 Horstman et al. ..... 336/210
2,930,012 A * 3/1960 Hufnagel ..... H01F 30/10 336/134
3,082,390 A * 3/1963 Peterson ..... H01F 27/263 336/197
3,307,132 A * 2/1967 Ellis ..... H01F 41/0206 29/609
3,662,308 A * 5/1972 Muschong ..... H01F 27/25 336/210
3,774,298 A * 11/1973 Eley ..... 29/605
3,792,399 A 2/1974 McLyman
4,352,080 A 9/1982 Mitsui et al.
4,424,504 A 1/1984 Mitsui et al.
4,599,595 A * 7/1986 Geschka ..... 336/178
4,603,314 A * 7/1986 Fukunaga et al. ..... 336/65
4,848,684 A 7/1989 Sasaki et al.
4,956,226 A * 9/1990 Ashizawa ..... C09K 3/10 277/654
5,546,065 A * 8/1996 Vinciarelli et al. ..... 336/84 C
(Continued)

*Primary Examiner* — Shawki S Ismail
*Assistant Examiner* — Kazi Hossain
(74) *Attorney, Agent, or Firm* — Patterson Intellectual Property Law, PC; Mark J. Patterson; Jerry Turner Sewell

(57) ABSTRACT

A magnetic component includes a first core half having a core body with first and second core legs protruding from the core body and a middle core leg protruding from the core body between the first and second core legs. A first U-shaped channel is defined between the first core leg and the middle core leg, and a second U-shaped channel is defined between the second core leg and the middle core leg. A first rounded outer core surface is disposed on the core body oriented substantially parallel to the first U-shaped channel, and a second rounded outer core surface is disposed on the core body oriented substantially parallel to the second U-shaped channel. In some embodiments, a second core half having a similar shape is positioned oppositely adjacent the first core, and a bobbin structure is positioned on the middle core legs such that the first and second U-shaped channels form transverse clearance openings in the magnetic component. Air can be passed transversely through the first and second U-shaped channels to extract heat from the magnetic component.

18 Claims, 3 Drawing Sheets

(56) References Cited

U.S. PATENT DOCUMENTS

| | | | | |
|---|---|---|---|---|
| 5,815,062 | A * | 9/1998 | Koyuhara et al. | 336/233 |
| 5,816,894 | A | 10/1998 | Hosozawa et al. | |
| 6,046,663 | A * | 4/2000 | Kubomura et al. | 336/198 |
| D463,365 | S | 9/2002 | Sakai et al. | |
| 6,696,913 | B2 | 2/2004 | Meuche et al. | |
| 6,917,275 | B2 * | 7/2005 | Ono et al. | 336/234 |
| 7,078,995 | B2 | 7/2006 | Hoffman et al. | |
| 7,414,511 | B2 * | 8/2008 | Wu et al. | 336/212 |
| 2004/0032313 | A1 * | 2/2004 | Ferencz | H01F 27/266 336/200 |
| 2010/0134044 | A1 * | 6/2010 | Sin | 315/294 |
| 2011/0234360 | A1 * | 9/2011 | Nakanoue et al. | 336/221 |

* cited by examiner

MAGNETIC COMPONENT HAVING A CORE STRUCTURE WITH CURVED OPENINGS

CROSS-REFERENCES TO RELATED APPLICATIONS

This application claims benefit of the following patent application(s) which is/are hereby incorporated by reference: U.S. Provisional Patent Application No. 61/308,322, filed Feb. 26, 2010.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to components for electronic circuits and more particularly to magnetic components having one or more conductive windings positioned around a magnetically permeable core.

Magnetic components having one or more windings disposed about a magnetically permeable core are known in the art and include inductors and transformers. Conventional magnetic components can include one or more cores combined to form a closed-loop magnetic flux path. Conventional cores having traditional and modified E-shapes are known in the art. Typically, a bobbin structure having a conductive winding disposed thereon is positioned on the middle leg of an E-shaped core such that the middle leg is received in a central bobbin void, and so that each outer leg of the E-shaped core extends along an outer side of the bobbin.

One problem associated with conventional E-shaped cores for use in magnetic components includes heat dissipation. Magnetic components such as transformers and inductors generate heat that can affect performance or damage other nearby circuit components. Conventional magnetic components using traditional E-shaped cores generally do not allow airflow between the bobbin and the core body when the bobbin is positioned on the middle core leg, allowing heat to build up in the core and bobbin.

Other problems associated with conventional E-shaped cores for use in magnetic components include inefficient flux utilization of core material and flux crowding. Such cores can include zones through which no magnetic flux travels, resulting in wasted core material.

What is needed, then, are improvements in devices and methods associated with magnetic components and magnetically permeable cores to improve heat dissipation and to improve flux utilization of core material.

BRIEF SUMMARY OF THE INVENTION

The present invention provides improved cores, magnetic components and electronic devices having cores with curved side walls. In some embodiments, the present invention includes a core having U-shaped channels defined between adjacent core legs, each channel having a corresponding rounded outer core surface on the core body facing away from the core legs.

One aspect of the present invention provides a core body having first and second core legs protruding outward from the core body. A middle core leg extends from the core body between the first and second core legs. A first U-shaped channel is defined in the core body between the first core leg and the middle core leg. A second U-shaped channel is defined in the core body between the second core leg and the middle core leg. A first rounded outer core surface is disposed on the core body facing away from the first core leg between the first core leg and the middle core leg. A second rounded outer core surface is disposed on the core body facing away from the second core leg between the second core leg and the middle core leg.

A further embodiment of the present invention provides a magnetic component for an electronic circuit. The component includes a bobbin defining an axial opening and including a first bobbin end wall and a second bobbin end wall. A conductive winding is disposed about the bobbin. A first core half includes a core body, first and second core legs protruding from the core body at opposing ends of the core body and a middle core leg protruding from the core body between the first and second core legs. The middle core leg extends into the axial opening. A first interior core surface is disposed between the first core leg and the middle core leg. The first interior core surface includes a first radius of curvature forming a first inner semicircle region. The first inner semicircle region extends from the first bobbin end wall forming a clearance opening through the magnetic component. Air can be passed through the clearance opening to remove heat from the magnetic component.

Numerous other objects, features and advantages of the present invention will be readily apparent to those skilled in the art upon a reading of the following disclosure when taken in conjunction with the accompanying drawings.

DETAILED DESCRIPTION

Figure 1:
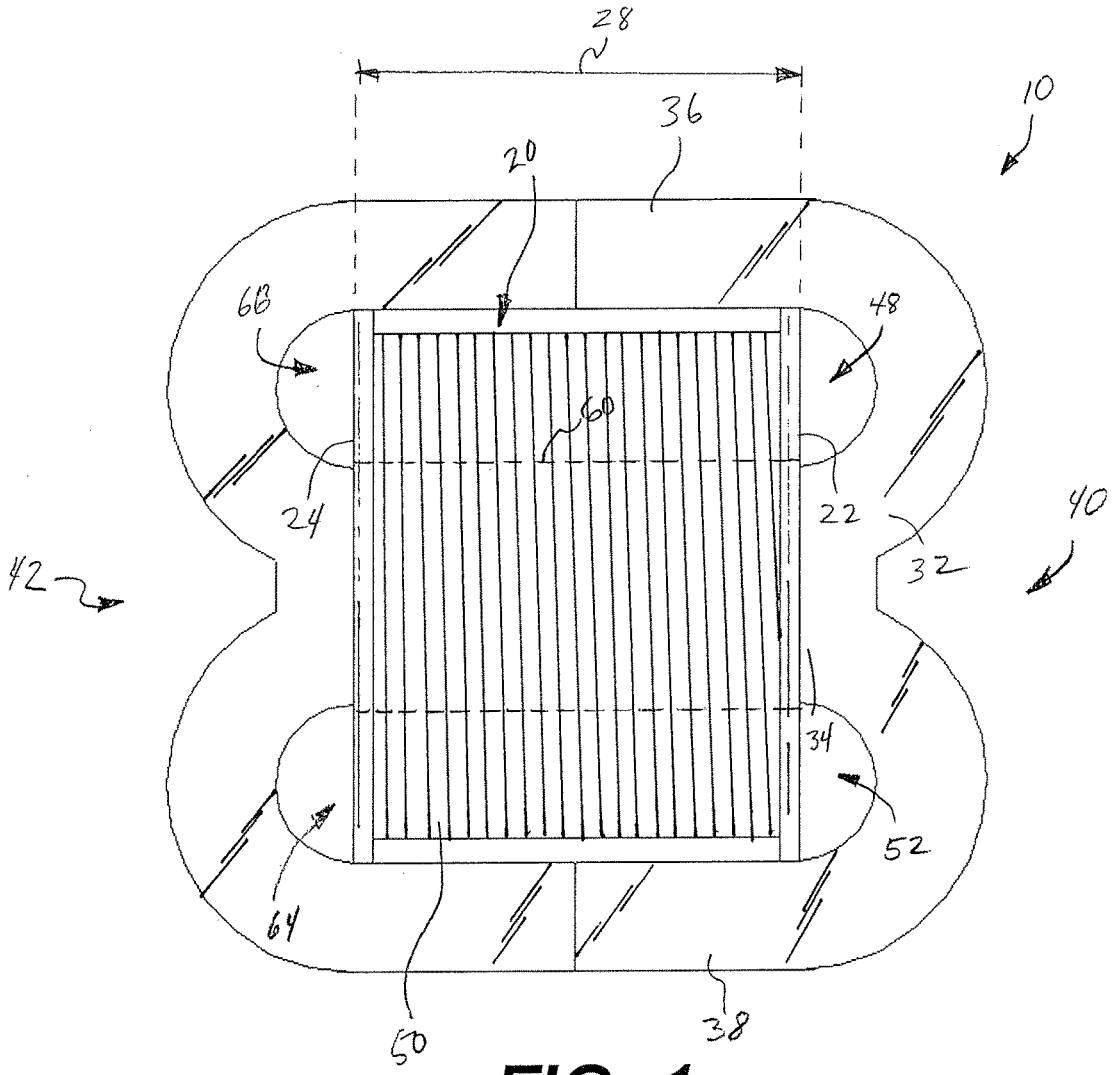
FIG. 1 is a plan view of an embodiment of a magnetic component in accordance with the present disclosure.
Figure 2:
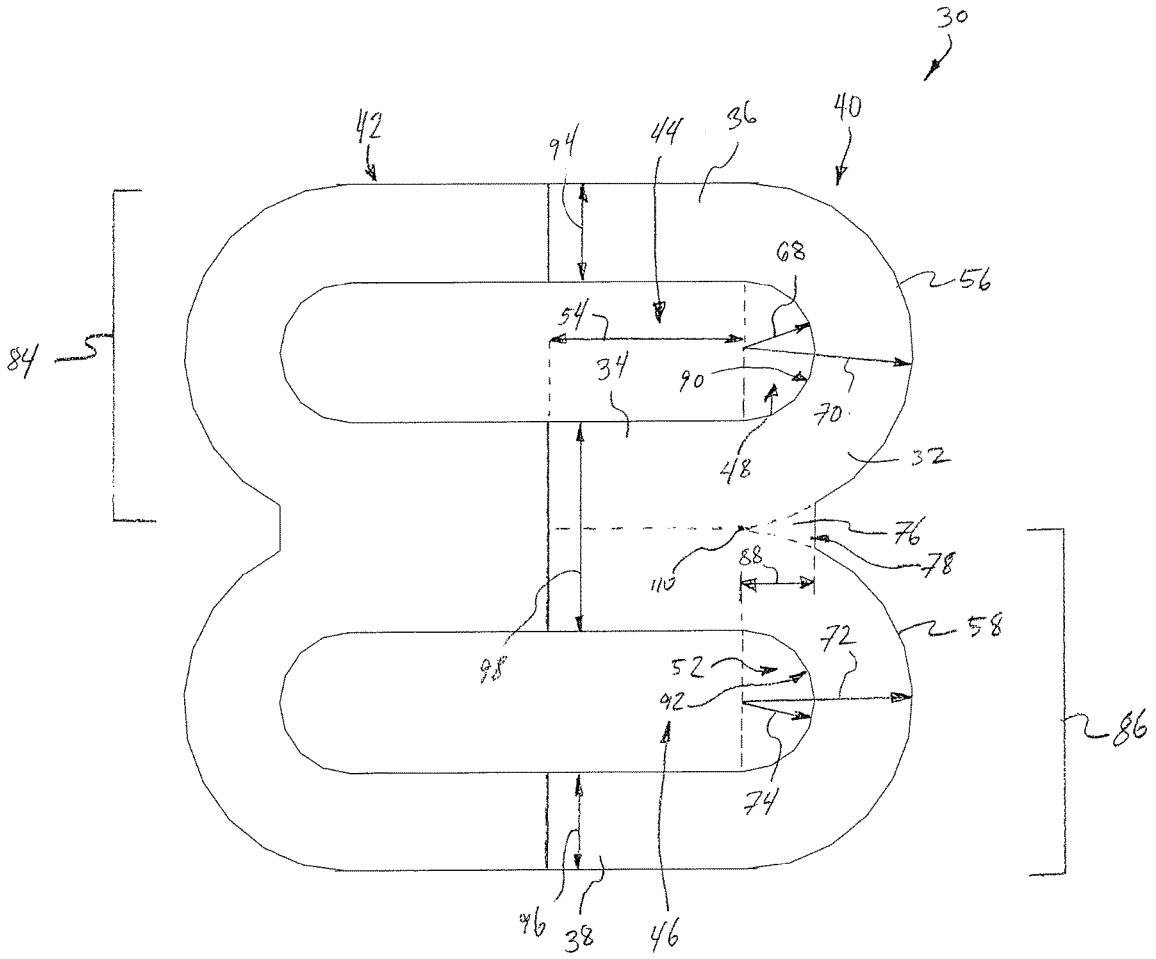
FIG. 2 is a plan view of first and second core halves positioned oppositely adjacent one another in accordance with the present disclosure.

Referring to FIG. 1, an embodiment, of a magnetic component 10 includes a core 40 having a core body 32. Core body 32 has a first core leg 36 and a second core leg 38 protruding from core body 32. A middle core leg 34 extends from core body 32 between first and second core legs 36, 38. As seen in FIG. 2, a first U-shaped channel 44 is defined in the core between the first core leg 36 and the middle core leg 34. The first U-shaped channel 44 has a first interior portion forming a first inner semicircle region 48. In some embodiments, the first inner semicircle region 48 has a constant first radius of curvature 68. The first inner semicircle region 48 of first U-shaped channel 44 forms a first interior curved surface 90.

A first rounded outer core surface 56 is disposed on the core body 32 facing away from the first U-shaped channel 44. The first rounded outer core surface 56 spans the core body between the first core leg 36 and the middle core leg 34. The first rounded outer core surface 56 is substantially parallel to the first interior curved surface 90 in some embodiments.

Referring further to FIG. 2, in some embodiments, a second U-shaped channel 46 is defined in the core between the second core leg 38 and the middle core leg 34. The second U-shaped channel 46 includes a second interior portion forming a second inner semicircle region 52. In some embodiments, the second inner semicircle region 52 has a constant second radius of curvature 74. The second inner semicircle region 52 of second U-shaped channel 46 forms a second interior curved surface 92.

A second rounded outer core surface 58 is disposed on the core body 32 facing away from the second U-shaped channel 46. The second rounded outer core surface 58 spans the core body 32 between the second core leg 38 and the middle core leg 34. The second rounded outer core surface 58 is substantially parallel to the second interior curved surface 92 in some embodiments.

Referring further to FIG. 2, in some embodiments, a filler bridge 76 is disposed on the core body 32 between the first rounded outer core surface 56 and the second rounded outer core surface 58. Filler bridge 76 can be integrally formed in core body 10 and can be formed from a magnetically permeable material. In some embodiments, filler bridge 76 defines a filler bridge surface 78 facing away from the middle core leg 34. In some embodiments, the filler bridge 76 reduces the stress concentration between the first and second rounded outer core surfaces 56, 58.

Figure 3:
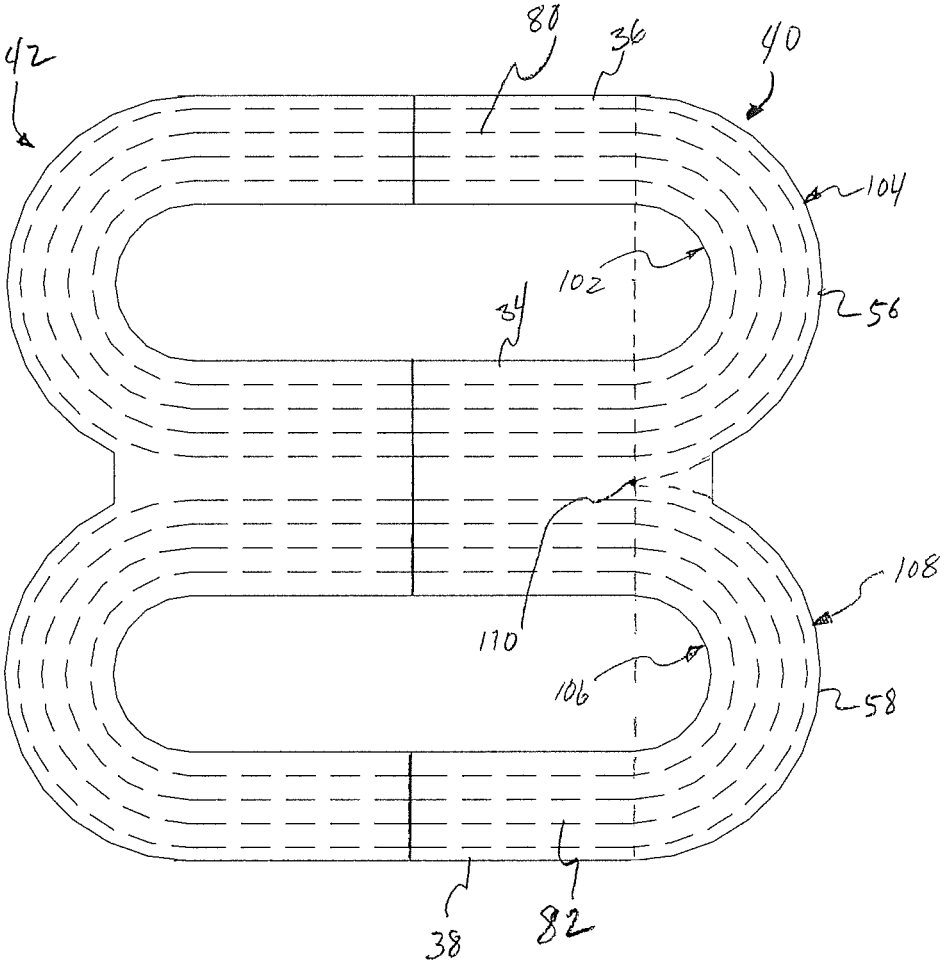
FIG. 3 is a plan view of the first and second core halves from FIG. 2 illustrating a flux path.

Referring further to FIG. 2 and FIG. 3, in some embodiments, the first U-shaped channel 44 has a first radius of curvature 68 defining a first inner semicircle 102. Similarly, the first rounded outer core surface 56 has a second radius of curvature 70 defining a first outer semicircle 104. In some embodiments, the first inner semicircle 102 and the first outer semicircle 108 are substantially concentric. Additionally, the second U-shaped channel 46 has a third radius of curvature 74 defining a second inner semicircle 106. The second rounded outer core surface 58 includes a fourth radius of curvature 72 defining a second outer semicircle 108. In some embodiments, the second inner semicircle 106 and the second outer semicircle 108 are substantially concentric. In some embodiments, the first and third radii of curvature 68, 74 are substantially equal. In further embodiments, the second and fourth radii of curvature 70, 72 are substantially equal and are greater than the first and third radii of curvature 68, 74.

As seen in FIG. 3, in some embodiments, the first and second outer semicircles 104, 108 intersect at a semicircle intersection point 110. As seen in FIG. 3, in some embodiments, filler bridge 76 defines a filler bridge length 88. Filler bridge length 88 extends from the semicircle intersection point 110 to the filler bridge surface 78. In some embodiments, the filler bridge length 88 is substantially equal to the first radius of curvature 68.

Referring further to FIG. 2, in some embodiments, the middle core leg 34 has a middle core leg width 98. Similarly, first core leg 36 has a first core leg width 94, and second core leg 38 has a second core leg width 96. In some embodiments, the second core leg width 96 is substantially equal to the first core leg width 94. In additional embodiments, the ratio of the middle core leg width to the first core leg width is equal to or greater than about two.

As seen in FIG. 2, in some embodiments, core 30 includes a first core half 40 and a second core half 42. First and second core halves 40, 42 can form identical parts, and second core half 42 is positioned opposite adjacent first core half 40. As such, second core half 42 is rotated one-hundred-eighty degrees relative to first core half 40 and is positioned such that one or more core legs of second core half 42 abut against corresponding core legs of first core half 40.

Referring again to FIG. 1, a magnetic component 10 includes a bobbin structure 20. Bobbin structure 20 includes an axial opening 60, and middle core leg 34 of first core half 40 extends into the axial opening 60. Similarly, a middle core leg of second core half 42 also extends into the axial opening from the opposite side. Bobbin structure 20 includes a first bobbin end wall 22 and a second bobbin end wall 24 positioned at the opposite end of the bobbin. In some embodiments, first core half 40 is positioned relative to the bobbin 20 such that first inner semicircle region 48 is positioned outside of bobbin 20, forming a first core opening adjacent first bobbin end wall 22. Similarly, second inner semicircle region 52 is positioned outside of bobbin 20, forming a second core opening adjacent first bobbin end wall 22. The first and second core openings, formed by first and second inner semicircles 48, 52, respectively, form clearance openings through which a heat transfer medium can be passed to remove heat from magnetic component 10. In some embodiments, air is passed through first and second core openings to remove heat from magnetic component 10. Also seen in FIG. 1, third and fourth inner semicircle regions 64, 66 in second core half 42 can form third and fourth core openings adjacent second bobbin end wall 24 on magnetic component 10. A heat transfer medium can be passed through third and fourth core openings to remove heat from magnetic component 10.

In some embodiments, bobbin 20 has a bobbin axial length 28. Additionally, middle core leg 34 has a middle core leg length 54 extending from the base of first inner semicircle 48 to the distal end of middle leg 34 protruding away from core body 32. The ratio of bobbin axial length 28 to middle core leg length 54 is equal to about two in some embodiments. This ratio provides first and second inner semicircle regions 48, 52 extending from first bobbin end wall 22.

A conductive winding 50 is disposed about bobbin 20 such that one or more turns of the conductive winding 50 are positioned about the middle core leg 34.

Referring further to FIGS. 2 and 3, a first magnetic flux 80 path forms a first loop 84 extending between first and middle core legs 36, 34 on first core half 40 and on corresponding oppositely adjacent core legs on second core half 42. First loop 84 includes an oval shape. Similarly, a second magnetic flux path 82 forms a second loop 86 extending between second and middle core legs 38, 34 on first core half 40 and on corresponding oppositely adjacent core legs on second core half 42. Second loop 86 also includes an oval shape. As such, first and second loops 84, 86 can reduce losses caused by flux crowding, as the magnetic flux paths associated with each loop take advantage of the semicircular shapes of each loop end. Such a core geometry also allows improved utilization of core material as compared to conventional E-shaped core designs that include linear corners.

In further embodiments, the present invention provides a method of forming a magnetically permeable core for a magnetic component. The method includes the steps of forming a first U-shaped member having two legs and a semicircular joint between the two legs. A second U-shaped member is formed having two legs and a second semicircular joint between the two legs. One of the legs of the first U-shaped member is joined to one of the legs of the second U-shaped member to form a modified E-shaped core having three core legs and rounded U-shaped channels positioned between adjacent core legs.

In additional embodiments, the present invention provides a method of cooling a magnetic component such as a transformer or inductor by passing a heat transfer medium through one or more semicircular clearance openings defined between adjacent core legs extending from an axial bobbin end.

In further embodiments, potting material can be disposed in one or more inner semicircle regions to provide enhanced heat dissipation, thermal stability and component performance.

It is further understood that various embodiments of the present invention include a core having a core material that is magnetically permeable, such as a ferrite. In further embodiments, the present invention is particularly suited for use with a powder core material. Such cores utilizing a powder core material in accordance with the present invention may be characterized as a distributed air gap core. For example, in some embodiments, first core half 40 and second core half 42 both comprise a powder core material. In other embodiments, first core half 40 and second core half 42 both comprise a ferrite core material.

Thus, although there have been described particular embodiments of the present invention of a new and useful Magnetic Component Having A Core Structure With Curved Openings it is not intended that such references be construed as limitations upon the scope of this invention except as set forth in the following claims.

What is claimed is:

1. An electric coil device comprising:

A modified E-core structure for a magnetic component comprising a unitary solid structure of a ferromagnetic material, the unitary solid structure comprising:

a core body comprising:

a first arcuate portion having a respective first end and a respective second end, the first arcuate portion comprising a first arcuate inner surface and a first arcuate outer surface, the outer surface of the first arcuate portion having a first constant outer radius of curvature between the first end and the second end of the first arcuate portion;

a second arcuate portion having a respective first end and a respective second end, the second end of the second arcuate portion adjacent the second end of the first arcuate portion, the second arcuate portion comprising a second arcuate inner surface and a second arcuate outer surface, the outer surface of the second arcuate portion having a second constant outer radius of curvature between the first end and the second end of the second arcuate portion; and a filler bridge disposed between the first arcuate outer surface and the second arcuate outer surface near the respective second ends of the first arcuate portion and the second arcuate portion of the core body, the filler bridge interconnecting the first arcuate portion and the second arcuate portion with magnetically permeable material, the filler bridge including a filler bridge surface facing away from the middle core leg;

a first outer leg protruding away from the first end of the first arcuate portion of the core body, the first outer leg having a respective outer surface and a respective inner surface;

a second outer leg protruding away from the first end of the second arcuate portion of the core body, the second outer leg having a respective inner surface and a respective outer surface, the second outer core leg parallel to the first outer core leg;

a middle core leg extending from the second ends of the first and second arcuate portions of the core body, the middle leg positioned between the respective inner surfaces of the first and second outer core legs and parallel to the first and second outer core legs, the middle core leg having a first surface facing the inner surface of the first outer leg and having a second surface facing the inner surface of the second outer leg;

wherein a first U-shaped channel is defined in the unitary core structure between the inner surface of the first outer core leg, the first surface of the middle core leg, and the first arcuate inner surface; and wherein a second U-shaped channel is defined in the unitary core structure between the inner surface of the second outer core leg, the second surface of the middle core leg, and the second arcuate inner surface.

2. The apparatus of claim 1, further comprising:

the middle core leg having a middle core leg width;

the first outer core leg having a first outer core leg width; and wherein a ratio of the middle core leg width to the first outer core leg width is about two.

3. The apparatus of claim 2, further comprising:

the second outer core leg having a second outer core leg width substantially equal to the first outer core leg width.

4. The apparatus of claim 1, further comprising:

a bobbin having an axial opening;

the middle core leg positioned in the axial opening; and wherein the bobbin is spaced apart from the first arcuate inner surface and the second arcuate inner surface.

5. The apparatus of claim 1, further comprising:

the first arcuate portion inner surface having a first semicircular inner profile having a first inner radius of curvature; and the first arcuate outer surface having a first semicircular outer profile having the first constant outer radius of curvature, wherein the first semicircular inner profile of the first arcuate inner surface and the first semicircular outer profile of the first arcuate outer core surface are substantially concentric.

6. The apparatus of claim 5, further comprising:

the second arcuate inner surface having a second semicircular profile having a second inner radius of curvature; and the second arcuate outer surface having a second semicircular outer profile having the second constant outer radius of curvature;

wherein the second semicircular inner profile of the second arcuate inner surface and the second semicircular outer profile of the second arcuate outer core surface are substantially concentric.

7. The apparatus of claim 6, wherein the first inner radius of curvature and the second inner radius of curvature are substantially equal.

8. The apparatus of claim 7, wherein the first constant outer radius of curvature and the second constant outer radius of curvature are substantially equal and are greater than the first inner radius of curvature and the second inner radius of curvature.

9. The apparatus of claim 6, wherein:

the first semicircular arcuate outer surface and the second semicircular arcuate outer surface intersect at an intersection point; and the filler bridge has a filler bridge length extending from the filler bridge surface to the intersection point.

10. The apparatus of claim 9, wherein the filler bridge length is substantially equal to the first inner radius of curvature.

11. A magnetic component for an electronic circuit comprising:

a bobbin including a first bobbin end wall, a second bobbin end wall and an axial opening extending through the bobbin from the first bobbin end wall to the second bobbin end wall;

a conductive winding disposed about the bobbin;

a first modified E-core half comprising a first unitary solid structure of a ferromagnetic material, the first unitary solid structure comprising:

a first core body, the first core body comprising:

a first arcuate portion having a first end and a second end; and a second arcuate portion having a first end and a second end, the second end of the second arcuate portion adjacent the second end of the first arcuate portion; and a filler bridge disposed between the first arcuate outer surface and the second arcuate outer surface near the respective second ends of the first arcuate portion and the second arcuate portion of the core body, the filler bridge interconnecting the first arcuate portion and the second arcuate portion with magnetically permeable material, the filler bridge including a filler bridge surface facing away from the middle core leg;

a first outer core leg extending from the first end of the first arcuate portion of the core body and second outer core leg extending from the first end of the second arcuate portion of the first core body;

a middle core leg protruding from the second ends of the first and second arcuate portions of the core body between the first and second outer core legs, the middle core leg extending into the axial opening at the first bobbin end wall;

the first arcuate portion of the core body having a first semicircular interior core surface disposed between the first core leg and the middle core leg, the first semicircular interior core surface including a first inner radius of curvature, the first interior surface having a first inner semicircular profile; and a first semicircular clearance opening defined between the first semicircular interior core surface and the first bobbin end wall.

12. The apparatus of claim 11, wherein the first semicircular clearance opening extends from the first bobbin end wall a distance substantially equal to the first inner radius of curvature.

13. The apparatus of claim 11, further comprising:

the first arcuate portion of the core body having a first rounded outer core surface having a first outer semicircular profile, the first outer semicircular profile having a first outer radius of curvature greater than the first inner radius of curvature; and wherein the first rounded outer core surface is substantially parallel to the first interior core surface.

14. The apparatus of claim 13, further comprising:

the second arcuate portion of the core body having a second semicircular interior core surface disposed between the second outer core leg and the middle core leg, the second semicircular interior core surface including a second inner radius of curvature, the second interior surface having a second inner semicircular profile; and a second semicircular clearance opening defined between the second interior core surface and the first bobbin end wall.

15. The apparatus of claim 14, wherein the second semicircular clearance opening extends from the first bobbin end wall a distance substantially equal to the second inner radius of curvature.

16. The apparatus of claim 14, further comprising:

a second rounded outer core surface having a second outer semicircular profile, the second outer semicircular profile having a second outer radius of curvature greater than the second inner radius of curvature; and wherein the second rounded outer core surface is substantially parallel to the second interior core surface.

17. The apparatus of claim 14, further comprising:

a second E-core half comprising a second unitary solid structure of a ferromagnetic material, the second unitary solid structure comprising:

a second core body comprising first and second arcuate portions having respective first and second ends, the second end of the first arcuate portion adjacent to the second end of the second arcuate; and a first outer leg extending from the first end of the first arcuate portion, a second outer leg extending from the first end of the second arcuate portion and a middle core leg extending from the second ends of the first and second arcuate portions, the middle core leg extending into the axial opening at the second bobbin end wall, the second core body providing a third semicircular opening with respect to the second bobbin end wall between the first outer core leg and the middle core leg and providing a fourth semicircular opening with respect to the second bobbin end wall between the second outer core leg and the middle core leg.

18. A modified E-core structure for a magnetic component comprising:

a core body including:

a first arcuate portion having a respective first end and a respective second end, the first arcuate portion having an inner surface and an outer surface, the inner surface of the first arcuate portion having a first constant inner radius of curvature between the first end and the second end of the first arcuate portion, the outer surface of the first arcuate portion having first constant outer radius of curvature between the first end and the second end of the first arcuate portion; and a second arcuate portion having a respective first end and a respective second end, the second end of the second arcuate portion adjacent the second end of the first arcuate portion, the second arcuate portion comprising an inner surface and an outer surface, the inner surface of the second arcuate portion having a second constant inner radius of curvature between the first end and the second end of the second arcuate portion, the outer surface of the second arcuate portion having a second constant outer radius of curvature between the first end and the second end of the second arcuate portion;

a first outer core leg protruding away from the first end of the first arcuate portion of the core body, the first outer core leg having a respective outer surface and a respective inner surface;

a second outer core leg protruding away from the first end of the second arcuate portion of the core body, the second outer core leg parallel to the first outer core leg, the second outer core leg having a respective inner surface and a respective outer surface;

a single middle core leg extending from the second end of the first arcuate portion of the core body and from the second end of the second arcuate portion of the core body, the middle leg positioned between the respective inner surfaces of the first and second outer core legs and parallel to the first and second outer core legs, the middle core leg having a first surface facing the inner surface of the first outer leg and having a second surface facing the inner surface of the second outer leg, the first surface of the middle core leg extending from the inner surface of the first arcuate surface, the second surface of the middle leg extending from the inner surface of the second arcuate portion, the middle leg comprising a solid, uninterrupted material between the first surface of the middle leg and the second surface of the middle leg;

wherein the core body, the first outer leg, the second outer leg and the middle leg comprise a single, unitary solid structure of a ferromagnetic material;

wherein a first U-shaped channel is defined in the unitary core structure between the inner surface of the first outer core leg, the first surface of the middle core leg, and the inner surface of the first arcuate portion; and wherein a second U-shaped channel is defined in the unitary core structure between the inner surface of the second outer core leg, the second surface of the middle core leg, and the inner surface of the second arcuate portion.

* * * * *